US011060172B2

(12) United States Patent
Takayama et al.

(10) Patent No.: US 11,060,172 B2
(45) Date of Patent: Jul. 13, 2021

(54) ABRASION-RESISTANT STEEL PLATE AND METHOD OF MANUFACTURING SAME

(71) Applicant: JFE STEEL CORPORATION, Tokyo (JP)

(72) Inventors: Naoki Takayama, Tokyo (JP); Yusuke Terazawa, Tokyo (JP); Yoshiaki Murakami, Tokyo (JP); Kazukuni Hase, Tokyo (JP); Yusaku Takemura, Tokyo (JP); Yasuhiro Murota, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 130 days.

(21) Appl. No.: 16/488,701

(22) PCT Filed: Feb. 2, 2018

(86) PCT No.: PCT/JP2018/003685
§ 371 (c)(1),
(2) Date: Aug. 26, 2019

(87) PCT Pub. No.: WO2018/168248
PCT Pub. Date: Sep. 20, 2018

(65) Prior Publication Data

US 2020/0248290 A1 Aug. 6, 2020

(30) Foreign Application Priority Data

Mar. 13, 2017 (JP) ..... JP2017-047263

(51) Int. Cl.

| | |
|---|---|
| ***C22C 38/00*** | (2006.01) |
| ***C22C 38/02*** | (2006.01) |
| ***C22C 38/54*** | (2006.01) |
| ***C21D 8/02*** | (2006.01) |
| ***C21D 9/46*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |
| ***C22C 38/52*** | (2006.01) |

(52) U.S. Cl.
CPC ..... *C22C 38/54* (2013.01); *C21D 8/0205* (2013.01); *C21D 8/0226* (2013.01); *C21D 9/46* (2013.01); *C22C 38/001* (2013.01); *C22C 38/002* (2013.01); *C22C 38/02* (2013.01); *C22C 38/06* (2013.01); *C22C 38/42* (2013.01); *C22C 38/44* (2013.01); *C22C 38/46* (2013.01); *C22C 38/50* (2013.01); *C22C 38/52* (2013.01)

(58) Field of Classification Search
None
See application file for complete search history.

(56) References Cited

U.S. PATENT DOCUMENTS

| | | | | |
|---|---|---|---|---|
| 7,713,362 | B2 | 5/2010 | Beguinot et al. | |
| 9,738,957 | B2 | 8/2017 | Ueda et al. | |
| 10,662,493 | B2 | 5/2020 | Yuga et al. | |
| 10,801,090 | B2 | 10/2020 | Zhao et al. | |
| 2005/0081962 | A1 | 4/2005 | Matsuzaki et al. | |
| 2006/0162826 | A1 | 7/2006 | Beguinot et al. | |
| 2012/0132322 | A1* | 5/2012 | Moody | C22C 38/02 148/547 |
| 2014/0124102 | A1* | 5/2014 | Zhang | C22C 38/002 148/506 |

FOREIGN PATENT DOCUMENTS

| | | | |
|---|---|---|---|
| CN | 1617943 | A | 5/2005 |
| CN | 1714159 | A | 12/2005 |
| CN | 1782117 | A | 6/2006 |
| CN | 103060715 | A | 4/2013 |
| CN | 104471095 | A | 3/2015 |
| CN | 104561502 | A | 4/2015 |
| CN | 105200337 | A | 12/2015 |
| CN | 105940133 | A | 9/2016 |
| EP | 1563105 | A1 | 8/2005 |
| EP | 2949775 | A1 | 12/2015 |
| JP | S6176615 | A | 4/1986 |

(Continued)

OTHER PUBLICATIONS

Nov. 3, 2020, Office Action issued by the China National Intellectual Property Administration in the corresponding Chinese Patent Application No. 201880014517.2 with English language search report.

(Continued)

*Primary Examiner* — Adam Krupicka
(74) *Attorney, Agent, or Firm* — Kenja IP Law PC

(57) ABSTRACT

Provided is an abrasion-resistant steel plate which has high hardness up to the mid-thickness part thereof although the steel plate is 50 mm or more, and can be manufactured at low cost. The abrasion-resistant steel plate has a specific chemical composition having DI* of 120 or more, where DI* is defined by the following Formula (1): $DI^*=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1)$ . . . (1), has $HB_1$ of 360 HBW10/3000 to 490 HBW10/3000, $HB_1$ being a Brinell hardness at a depth of 1 mm from a surface, has a hardness ratio, $HB_{1/2}$ to $HB_1$, of 75% or more, $HB_{1/2}$ being a Brinell hardness at a mid-thickness position, and has a plate thickness of 50 mm or more.

8 Claims, No Drawings

(56) References Cited

FOREIGN PATENT DOCUMENTS

| | | | |
|---|---|---|---|
| JP | H08144009 | A | 6/1996 |
| JP | H09118950 | A | 5/1997 |
| JP | 2001049387 | A | 2/2001 |
| JP | 2002256382 | A | 9/2002 |
| JP | 2004300474 | A | 10/2004 |
| JP | 4645306 | B2 | 3/2011 |
| JP | 4735191 | B2 | 7/2011 |
| JP | 2014025130 | A | 2/2014 |
| JP | 2017193740 | A | 10/2017 |
| KR | 1020120071614 | A | 7/2012 |

OTHER PUBLICATIONS

May 19, 2020, Office Action issued by the IP Australia in the corresponding Australian Patent Application No. 2018236313.
Feb. 12, 2019, Notification of Reasons for Refusal issued by the Japan Patent Office in the corresponding Japanese Patent Application No. 2018-524298 with English language Concise Statement of Relevance.
May 1, 2018, International Search Report issued in the International Patent Application No. PCT/JP2018/003685.
Jan. 27, 2020, the Extended European Search Report issued by the European Patent Office in the corresponding European Patent Application No. 18768474.1.

* cited by examiner

ABRASION-RESISTANT STEEL PLATE AND METHOD OF MANUFACTURING SAME

TECHNICAL FIELD

The disclosure relates to an abrasion-resistant steel plate, in particular, an abrasion-resistant steel plate which has high hardness in the mid-thickness part thereof although the steel plate is thick, and can be manufactured at low cost. The abrasion-resistant steel plate can be suitably utilized for members of industrial machines and transport apparatuses which are used in fields such as construction, civil engineering, and excavation like mining. Further, the disclosure relates to a method of manufacturing the abrasion-resistant steel plate.

BACKGROUND

The abrasion resistance of steel is known to be improved by increasing the hardness of the steel. Therefore, high hardness steel has been widely used as abrasion-resistant steel, the high hardness steel being obtained by subjecting alloy steel added with a large amount of alloying elements such as Mn, Cr, and Mo to heat treatment such as quenching.

For example, JP 4645306 B (PTL 1) and JP 4735191 B (PTL 2) propose an abrasion-resistant steel plate having a Brinell hardness (HB) of 360 to 490 in its surface layer. In the abrasion-resistant steel plate, the high surface hardness is achieved by adding a predetermined amount of alloying elements and quenching the steel plate to obtain a martensite dominant microstructure.

CITATION LIST

Patent Literatures

PTL 1: JP 4645306 B
PTL 2: JP 4735191 B

SUMMARY

Technical Problem

In some operating environments of an abrasion-resistant steel plate, a steel plate with a plate thickness as thick as tens of millimeters is used until it is worn near to the mid-thickness part thereof. Therefore, to prolong the service life of a steel plate, it is important that the steel plate has high hardness not only in its surface layer but also in its mid-thickness part.

PTL 1 and 2, however, do not consider the hardness in the mid-thickness position of a thick abrasion-resistant steel plate. PTL 1 and PTL 2 also have a problem of cost increase because a large amount of alloying elements needs to be added to guarantee the hardness in the mid-thickness part of a thick abrasion-resistant steel plate.

The present disclosure has been made in view of the above, and an object of the present disclosure is to provide an abrasion-resistant steel plate which has high hardness in the mid-thickness part thereof although the steel plate has a plate thickness as thick as 50 mm or more, and can be manufactured at low cost. Further, the object of the present disclosure is to provide a method of manufacturing the abrasion-resistant steel plate.

Solution to Problem

To achieve the above object, we made intensive studies as to various factors which affect the hardness in the mid-thickness position of an abrasion-resistant steel plate. As the result, we found that by subjecting a steel plate having a high content of carbon to regular quenching treatment and then to tempering under specific conditions, an abrasion-resistant steel plate having high hardness in the mid-thickness part thereof can be manufactured although the steel plate has low contents of alloying elements other than carbon.

The disclosure is based on the aforementioned findings and further studies. We provide the following.

1. An abrasion-resistant steel plate, having a chemical composition containing (consisting of), in mass %, C: 0.23% to 0.34%,
Si: 0.05% to 1.00%,
Mn: 0.30% to 2.00%,
P: 0.020% or less,
S: 0.020% or less,
Al: 0.04% or less,
Cr: 0.05% to 2.00%,
N: 0.0050% or less, and
O: 0.0050% or less, with the balance being Fe and inevitable impurities, the chemical composition having a DI* value of 120 or more, where DI* is defined by the following Formula (1):

$$DI^{*}=33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1) \quad (1)$$

where each element symbol in Formula (1) indicates a content, in mass %, of a corresponding element and is taken to be 0 when the corresponding element is not contained, wherein the abrasion-resistant steel plate has $HB_1$ of 360 HBW10/3000 to 490 HBW10/3000, $HB_1$ being a Brinell hardness at a depth of 1 mm from a surface of the abrasion-resistant steel plate, wherein the abrasion-resistant steel plate has a hardness ratio of 75% or more, the hardness ratio being defined as a ratio of $HB_{1/2}$ to $HB_1$, and $HB_{1/2}$ being a Brinell hardness at the mid-thickness position of the abrasion-resistant steel plate, and wherein the abrasion-resistant steel plate has a plate thickness of 50 mm or more.

2. The abrasion-resistant steel plate according to 1., wherein the chemical composition further contains, in mass %, one or more selected from the group consisting of Cu: 0.01% to 2.00%,
Ni: 0.01% to 2.00%,
Mo: 0.01% to 1.00%,
V: 0.01% to 1.00%,
W: 0.01% to 1.00%, and
Co: 0.01% to 1.00%.

3. The abrasion-resistant steel plate according to 1. or 2., wherein the chemical composition further contains, in mass %, one or more selected from the group consisting of Nb: 0.005% to 0.050%,
Ti: 0.005% to 0.050%, and
B: 0.0001% to 0.0100%.

4. The abrasion-resistant steel plate according to any one of 1. to 3., wherein the chemical composition further contains, in mass %, one or more selected from the group consisting of Ca: 0.0005% to 0.0050%,
Mg: 0.0005% to 0.0050%, and
REM: 0.0005% to 0.0080%.

5. A method of manufacturing an abrasion-resistant steel plate, comprising:

heating a steel raw material to a heating temperature, the steel raw material having a chemical composition containing, in mass %, C: 0.23% to 0.34%, Si: 0.05% to 1.00%, Mn: 0.30% to 2.00%, P: 0.020% or less, S: 0.020% or less, Al: 0.04% or less, Cr: 0.05% to 2.00%, N: 0.0050% or less, and O: 0.0050% or less, with the balance being Fe and inevitable impurities;

hot rolling the heated steel raw material into a hot-rolled steel plate with a plate thickness of 50 mm or more;

subjecting the hot-rolled steel plate to quenching, the quenching being either direct quenching or reheating quenching, the direct quenching having a quenching start temperature of the $Ar_3$ transformation point or higher, the reheating quenching having a quenching start temperature of the $Ac_3$ transformation point or higher; and subjecting the hot-rolled steel plate after the quenching to tempering under condition such that a P value is $1.20\times10^4$ to $1.80\times10^4$, the P value being defined by the following Formula (2):

$$P=(T+273)\times(21.3-5.8\times C+\log(60\times t)) \quad (2),$$

where, in the Formula (2), C indicates the C content (in mass %) in the steel plate, T indicates the tempering temperature (° C.), and t indicates the holding time (min.) in the tempering.

6. The method of manufacturing an abrasion-resistant steel plate according to 5., wherein the chemical composition further contains, in mass %, one or more selected from the group consisting of Cu: 0.01% to 2.00%, Ni: 0.01% to 2.00%, Mo: 0.01% to 1.00%, V: 0.01% to 1.00%, W: 0.01% to 1.00%, and Co: 0.01% to 1.00%.

7. The method of manufacturing an abrasion-resistant steel plate according to 5. or 6., wherein the chemical composition further contains, in mass %, one or more selected from the group consisting of Nb: 0.005% to 0.050%, Ti: 0.005% to 0.050%, and B: 0.0001% to 0.0100%.

8. The method of manufacturing an abrasion-resistant steel plate according to any one of 5. to 7., wherein the chemical composition further contains, in mass %, one or more selected from the group consisting of Ca: 0.0005% to 0.0050%, Mg: 0.0005% to 0.0050%, and REM: 0.0005% to 0.0080%.

Advantageous Effect

It is possible to obtain an abrasion-resistant steel plate having high hardness in the mid-thickness part thereof at low cost although the steel plate has a plate thickness as thick as 50 mm or more.

DETAILED DESCRIPTION

[Chemical Composition]

Next, a method of implementing the present disclosure is described in detail below. It is important that an abrasion-resistant steel plate and a steel raw material used for manufacturing the abrasion-resistant steel plate have the chemical composition described above. Therefore, the reasons for limiting the steel chemical composition as stated above are described first. In the chemical composition, "%" denotes "mass %" unless otherwise noted.

C: 0.23% to 0.34%

C is an element that has an effect of increasing the hardness in a surface layer and a mid-thickness position and improving the abrasion resistance. To obtain this effect, the C content is set to be 0.23% or more. To further reduce required amounts of other alloying elements and manufacture the abrasion-resistant steel plate at low cost, the C content is preferably 0.25% or more. On the other hand, when the C content exceeds 0.34%, the hardness of a surface layer is excessively increased during quenching heat treatment to thereby raise a heating temperature required for tempering heat treatment, thus increasing heat treatment costs. Accordingly, the C content is 0.34% or less. To further decrease the temperature required for tempering, the C content is preferably 0.32% or less.

Si: 0.05% to 1.00%

Si is an element that functions as a deoxidizer. Si also has an effect of being dissolved in steel and increasing the hardness of a matrix of the steel by solid solution strengthening. To obtain these effects, the Si content is set to be 0.05% or more. The Si content is preferably 0.10% or more, and more preferably 0.20% or more. On the other hand, if the Si content exceeds 1.00%, the ductility and the toughness are decreased, and additionally, the amount of inclusions is increased. Accordingly, the Si content is 1.00% or less. The Si content is preferably 0.80% or less, more preferably 0.60% or less, and further preferably 0.40% or less.

Mn: 0.30% to 2.00%

Mn is an element that has an effect of increasing the hardness in a surface layer and a mid-thickness position and improving the abrasion resistance. To obtain this effect, the Mn content is set to be 0.30% or more. The Mn content is preferably 0.70% or more, and more preferably 0.90% or more. On the other hand, if the Mn content exceeds 2.00%, the weldability and the toughness are decreased, and additionally, alloy costs are excessively increased. Accordingly, the Mn content is 2.00% or less. The Mn content is preferably 1.80% or less, and more preferably 1.60% or less.

P: 0.020% or less

P is an element contained as an inevitable impurity, which causes an adverse effect such as a decrease in the toughness in a base metal and a welded portion due to the segregation to grain boundaries. Accordingly, the P content is desirably as low as possible, but the P content of 0.020% or less is allowable. Thus, the P content is set to be 0.020% or less. On the other hand, the P content may have any lower limit. The lower limit may be 0%, but in industrial terms, may be more than 0% because typically, P is an element inevitably contained as an impurity in steel. Further, excessively reducing the P content leads to an increase in refining costs. Thus, the P content is preferably 0.001% or more.

S: 0.020% or less

S is an element inevitably contained as an inevitable impurity, and exists in steel as a sulfide inclusion such as MnS, which causes an adverse effect of generating the fracture origin. Accordingly, the S content is desirably as low as possible, but the S content of 0.020% or less is allowable. Thus, the S content is set to be 0.020% or less. On the other hand, the S content may have any lower limit. The lower limit may be 0%, but in industrial terms, may be more than 0% because typically, S is an element inevitably contained as an impurity in steel. Further, excessively reducing the S content leads to an increase in refining costs. Thus, the S content is preferably 0.0005% or more.

Al: 0.04% or less

Al is an element that functions as a deoxidizer and has an effect of refining crystal grains. However, if the Al content exceeds 0.04%, an oxide-based inclusion is increased, thus decreasing the cleanliness. Accordingly, the Al content is 0.04% or less. The Al content is preferably 0.03% or less, and more preferably 0.02% or less. On the other hand, the Al content may have any lower limit, but to further enhance the effect of adding Al, the Al content is preferably 0.01% or more.

Cr: 0.05% to 2.00%

Cr is an element that has an effect of increasing the hardness in a surface layer and a mid-thickness position and improving the abrasion resistance. To obtain this effect, the Cr content is set to be 0.05% or more. The Cr content is preferably 0.20% or more, and more preferably 0.25% or more. On the other hand, if the C content exceeds 2.00%, the weldability is decreased. Accordingly, the Cr content is 2.00% or less. The Cr content is preferably 1.85% or less, and more preferably 1.80% or less.

N: 0.0050% or less

N is an element inevitably contained as an inevitable impurity, but the N content of 0.0050% or less is allowable. Accordingly, the N content is 0.0050% or less, and preferably 0.0040% or less. On the other hand, the N content may have any lower limit. The lower limit may be 0%, but in industrial terms, may be more than 0% because typically, N is an element inevitably contained as an impurity in steel.

O: 0.0050% or less

O is an element inevitably contained as an inevitable impurity, but the O content of 0.0050% or less is allowable. Accordingly, the O content is 0.0050% or less, and preferably 0.0040% or less. On the other hand, the O content may have any lower limit. The lower limit may be 0%, but in industrial terms, may be more than 0% because typically, O is an element inevitably contained as an impurity in steel.

An abrasion-resistant steel plate and a steel raw material in one of the embodiments have the aforementioned components with the balance being Fe and inevitable impurities.

In addition to the basic chemical composition described above, the chemical composition may optionally further contain one or more selected from the group consisting of Cu: 0.01% to 2.00%, Ni: 0.01% to 2.00%, Mo: 0.01% to 1.00%, V: 0.01% to 1.00%, W: 0.01% to 1.00%, and Co: 0.01% to 1.00%.

Cu: 0.01% to 2.00%

Cu is an element that has an effect of improving the quench hardenability and may be optionally added to further improve the hardness of the inside of a steel plate. In the case of adding Cu, to obtain this effect, the Cu content is set to be 0.01% or more. On the other hand, when the Cu content exceeds 2.00%, the weldability is deteriorated and alloy costs are increased. Accordingly, in the case of adding Cu, the Cu content is set to be 2.00% or less.

Ni: 0.01% to 2.00%

Ni is an element that has an effect of improving the quench hardenability as with Cu and may be optionally added to further improve the hardness of the inside of a steel plate. In the case of adding Ni, to obtain this effect, the Ni content is set to be 0.01% or more. On the other hand, when the Ni content exceeds 2.00%, the weldability is deteriorated and alloy costs are increased. Accordingly, in the case of adding Ni, the Ni content is set to be 2.00% or less.

Mo: 0.01% to 1.00%

Mo is an element that has an effect of improving the quench hardenability as with Cu and may be optionally added to further improve the hardness of the inside of a steel plate. In the case of adding Mo, to obtain this effect, the Mo content is set to be 0.01% or more. On the other hand, when the Mo content exceeds 1.00%, the weldability is deteriorated and alloy costs are increased. Accordingly, in the case of adding Mo, the Mo content is set to be 1.00% or less.

V: 0.01% to 1.00%

V is an element that has an effect of improving the quench hardenability as with Cu and may be optionally added to further improve the hardness of the inside of a steel plate. In the case of adding V, to obtain this effect, the V content is set to be 0.01% or more. On the other hand, when the V content exceeds 1.00%, the weldability is deteriorated and alloy costs are increased. Accordingly, in the case of adding V, the V content is set to be 1.00% or less.

W: 0.01% to 1.00%

W is an element that has an effect of improving the quench hardenability as with Cu and may be optionally added to further improve the hardness of the inside of a steel plate. In the case of adding W, to obtain this effect, the W content is set to be 0.01% or more. On the other hand, when the W content exceeds 1.00%, the weldability is deteriorated and alloy costs are increased. Accordingly, in the case of adding W, the W content is set to be 1.00% or less.

Co: 0.01% to 1.00%

Co is an element that has an effect of improving the quench hardenability as with Cu and may be optionally added to further improve the hardness of the inside of a steel plate. In the case of adding Co, to obtain this effect, the Co content is set to be 0.01% or more. On the other hand, when the Co content exceeds 1.00%, the weldability is deteriorated and alloy costs are increased. Therefore, when Co is added, the Co content is set to be 1.00% or less.

In other embodiments, the chemical composition can further optionally contain one or more selected from the group consisting of Nb: 0.005% to 0.050%, Ti: 0.005% to 0.050%, and B: 0.0001% to 0.0100%.

Nb: 0.005% to 0.050%

Nb is an element that further increases the hardness of a matrix and contributes to further improvement of the abrasion resistance. In the case of adding Nb, to obtain this effect, the Nb content is set to be 0.005% or more. The Nb content is preferably 0.007% or more. On the other hand, when the Nb content exceeds 0.050%, a large amount of NbC is precipitated, thus decreasing the workability. Accordingly, in the case of adding Nb, the Nb content is 0.050% or less. The Nb content is preferably 0.040% or less, and more preferably 0.030% or less.

Ti: 0.005% to 0.050%

Ti is an element that has a strong tendency to form nitride and has an effect of fixing N to decrease solute N. Therefore, the addition of Ti can improve the toughness of a base metal and a welded portion. Further, in the case of adding both Ti and B, Ti fixes N to thereby prevent precipitation of BN, thus improving an effect of B which increases the quench hardenability. To obtain these effects, in the case of adding Ti, the Ti content is set to be 0.005% or more. The Ti content is preferably 0.012% or more. On the other hand, if the Ti content exceeds 0.050%, a large amount of TiC is precipitated, thus decreasing the workability. Accordingly, when Ti is contained, the Ti content is set to be 0.050% or less. The Ti content is preferably 0.040% or less, and more preferably 0.030% or less.

B: 0.0001% to 0.0100%

B is an element which has an effect of significantly improving the quench hardenability even with an addition of a trace amount of B. Therefore, the addition of B can facilitate the formation of martensite, further improving the abrasion resistance. To obtain this effect, in the case of adding B, the B content is set to be 0.0001% or more. The B content is preferably 0.0005% or more, and more preferably 0.0010% or more. On the other hand, when the B content exceeds 0.0100%, the weldability is decreased. Accordingly, in the case of adding B, the B content is 0.0100% or less. The B content is preferably 0.0050% or less, and more preferably 0.0030% or less.

In other embodiments, the chemical composition can further optionally contain one or more selected from the group consisting of Ca: 0.0005% to 0.0050%, Mg: 0.0005% to 0.0050%, and REM: 0.0005% to 0.0080%.

Ca: 0.0005% to 0.0050%

Ca is an element that combines with S and has an effect of preventing the formation of, for example, MnS which extends long in a rolling direction. Therefore, the addition of Ca can provide morphological control on sulfide inclusions so that the sulfide inclusions may have a spherical shape, further improving the toughness of a welded portion and the like. To obtain this effect, in the case of adding Ca, the Ca content is set to be 0.0005% or more. On the other hand, when the Ca content exceeds 0.0050%, the cleanliness of steel is decreased. The decrease in the cleanliness causes deterioration of surface characteristics due to an increase in surface defects, and a decrease in the bending workability. Accordingly, in the case of adding Ca, the Ca content is 0.0050% or less.

Mg: 0.0005% to 0.0050%

Mg is an element that combines with S as with Ca, and has an effect of preventing the formation of, for example, MnS which extends long in a rolling direction. Therefore, the addition of Mg can provide morphological control on sulfide inclusions so that the sulfide inclusions may have a spherical shape, further improving the toughness of a welded portion and the like. To obtain this effect, in the case of adding Mg, the Mg content is set to be 0.0005% or more. On the other hand, when the Mg content exceeds 0.0050%, the cleanliness of steel is decreased. The decrease in the cleanliness causes deterioration of surface characteristics due to an increase in surface defects, and a decrease in the bending workability. Accordingly, in the case of adding Mg, the Mg content is 0.0050% or less.

REM: 0.0005% to 0.0080%

REM (rare-earth metal) is an element that combines with S as with Ca and Mg, and has an effect of preventing the formation of, for example, MnS which extends long in a rolling direction. Therefore, the addition of REM can provide morphological control on sulfide inclusions so that the sulfide inclusions may have a spherical shape, further improving the toughness of a welded portion and the like. To obtain this effect, in the case of adding REM, the REM content is set to be 0.0005% or more. On the other hand, when the REM content exceeds 0.0080%, the cleanliness of steel is decreased. The decrease in the cleanliness causes deterioration of surface characteristics due to an increase in surface defects, and a decrease in the bending workability. Accordingly, in the case of adding REM, the REM content is 0.0080% or less.

In other words, the abrasion-resistant steel plate and the steel raw material used for manufacturing the abrasion-resistant steel plate can have the following chemical composition.

In mass %, the chemical composition containing

C: 0.23% to 0.34%,

Si: 0.05% to 1.00%,

Mn: 0.30% to 2.00%,

P: 0.020% or less,

S: 0.020% or less,

Al: 0.04% or less,

Cr: 0.05% to 2.00%,

N: 0.0050% or less,

O: 0.0050% or less, optionally, one or more selected from the group consisting of Cu: 0.01% to 2.00%, Ni: 0.01% to 2.00%, Mo: 0.01% to 1.00%, V: 0.01% to 1.00%, W: 0.01% to 1.00%, and Co: 0.01% to 1.00%, optionally, one or more selected from the group consisting of Nb: 0.005% to 0.050%, Ti: 0.005% to 0.050%, and B: 0.0001% to 0.0100%, and optionally, one or more selected from the group consisting of Ca: 0.0005% to 0.0050%, Mg: 0.0005% to 0.0050%, and REM: 0.0005% to 0.0080%, with the balance being Fe and inevitable impurities.

DI*: 120 or more

DI* defined by the following Formula (1) is an index indicating the quench hardenability. As the DI* value is increased, the hardness is increased in the mid-thickness position of a steel plate after quenching. To guarantee the center hardness in thick abrasion-resistant steel, DI* needs to be 120 or more. On the other hand, DI* may have any upper limit, but when DI* is too high, the weldability is deteriorated. Therefore, DI* is preferably 300 or less, and more preferably 250 or less.

$$DI^* = 33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1) \quad (1)$$

where each element symbol in Formula (1) indicates a content, in mass %, of a corresponding element and is taken to be 0 when the corresponding element is not contained.

[Surface Hardness]

$HB_1$: 360 HBW10/3000 to 490 HBW10/3000

The abrasion resistance of a steel plate can be improved by increasing the hardness in a surface layer of the steel plate. When the hardness in a surface layer of a steel plate is less than 360 HBW in Brinell hardness, enough abrasion resistance cannot be obtained. Therefore, the Brinell hardness at a depth of 1 mm from a surface of an abrasion-resistant steel plate ($HB_1$) is 360 HBW or more. On the other hand, when $HB_1$ is higher than 490 HBW, the workability is deteriorated. Therefore, $HB_1$ is 490 HBW or less.

[Hardness Ratio]

$HB_{1/2}/HB_1$: 75% or more

As described above, in order that a steel plate may exhibit excellent abrasion resistance in a severe operating environment in which a steel plate is worn near to its mid-thickness part, and may have a prolonged service life, the steel plate needs to have high hardness not only in its surface layer but also in its mid-thickness part. Therefore, our abrasion-resistant steel plate has a hardness ratio, $HB_{1/2}$ to $HB_1$, of 75% or more ($HB_{1/2}/HB_1 \geq 0.75$), $HB_{1/2}$ being a Brinell hardness in the mid-thickness position of the abrasion-resistant steel plate. As used herein, the hardness ratio is $HB_{1/2}$ $HB_1 \times 100(\%)$. The hardness ratio is preferably 80% or more. On the other hand, the hardness ratio may have any upper limit, but $HB_{1/2}$ is typically $HB_1$ or less, and thus the hardness ratio is 100% or less ($HB_{1/2}/HB_1 \leq 1$).

Methods of achieving a hardness ratio of 75% or more in an abrasion-resistant steel plate with a plate thickness of 50 mm or more include a method in which a large amount of alloying elements is added to generate a large amount of martensite even in a mid-thickness part, thus increasing the hardness. However, the method uses a large amount of expensive alloying elements, thus significantly increasing costs. Our abrasion-resistant steel plate can have a hardness ratio of 75% or more by subjecting a steel plate having the aforementioned chemical composition to tempering heat treatment under the following specific conditions. The steel plate does not contain a large amount of alloying elements and is manufactured at low cost, but nevertheless, as described above, has a hardness ratio roughly equivalent to one yielded in the case that a large amount of alloying elements is used.

The Brinell hardness ($HB_1$, $HB_{1/2}$) is a value measured under a load of 3000 Kgf using a tungsten hard ball with a diameter of 10 mm (HBW10/3000). The Brinell hardness can be measured by a method described in Examples.

[Plate Thickness]

Plate thickness: 50 mm or more

Our abrasion-resistant steel plate can guarantee hardness in a mid-thickness part with a small amount of alloying elements, thus decreasing the cost of the abrasion-resistant steel plate. When the plate thickness is less than 50 mm, however, conventional techniques can achieve enough internal hardness with a small amount of alloying elements. Therefore, our cost reduction effect is particularly remarkable when the plate thickness is 50 mm or more. Thus, the plate thickness of the abrasion-resistant steel plate is 50 mm or more. On the other hand, the plate thickness may have any upper limit, but in terms of manufacturing, the plate thickness is preferably 100 mm or less.

[Manufacturing Method]

The following describes a method of manufacturing an abrasion-resistant steel plate according to one of the embodiments. The abrasion-resistant steel plate can be manufactured by heating a steel raw material having the aforementioned chemical composition, hot rolling the steel raw material, and subsequently subjecting the steel raw material to heat treatment including quenching and tempering under the following conditions.

[Steel Raw Material]

The steel raw material may be manufactured by any method, but for example, can be manufactured by molten steel having the aforementioned chemical composition by a conventional steelmaking process and subjecting the steel to casting. The steelmaking process can be performed by any method using a converter steelmaking process, an electric steelmaking process, an induction heating process, and the like. The casting is preferably performed by continuous casting in terms of productivity, but can also be performed by ingot casting and blooming. As the steel raw material, for example, a steel slab can be used.

[Heating]

The obtained steel raw material is heated to heating temperature before hot rolling. The steel raw material obtained by a method such as casting may be once cooled before heating, or may be directly heated without cooling.

The heating temperature is not limited, but when the heating temperature is 900° C. or more, the deformation resistance of the steel raw material is lowered to reduce a load on a mill during hot rolling, thus facilitating the hot rolling. Therefore, the heating temperature is preferably 900° C. or more, more preferably 950° C. or more, and further preferably 1100° C. or more. On the other hand, when the heating temperature is 1250° C. or less, the oxidation of steel is prevented to reduce loss due to the oxidation, resulting in the further improvement of the yield rate. Therefore, the heating temperature is preferably 1250° C. or less, more preferably 1200° C. or less, and further preferably 1150° C. or less.

[Hot Rolling]

The heated steel raw material is then hot rolled into a hot-rolled steel plate with a plate thickness of 50 mm or more. The hot rolling has no particular conditions and can be performed by a conventional method, but when the rolling temperature is 850° C. or more, the deformation resistance of the steel raw material is lowered to reduce a load on a mill during hot rolling, thus facilitating the hot rolling. Therefore, the rolling temperature is preferably 850° C. or more, and more preferably 900° C. or more. On the other hand, when the rolling temperature is 1000° C. or less, the oxidation of steel is prevented to reduce loss due to the oxidation, resulting in the further improvement of the yield rate. Therefore, the rolling temperature is preferably 1000° C. or less, and more preferably 950° C. or less.

[Quenching]

The obtained hot-rolled steel plate is then quenched from a quenching start temperature to a quenching end temperature. The quenching may be direct quenching (DQ) or reheating quenching (RQ). The quenching may be performed by any cooling method, but the quenching is preferably performed with water. As used herein, the "quenching start temperature" is a temperature of a surface of a steel plate at the start of the quenching. The "quenching start temperature" may be simply referred to as "quenching temperature". Further, the "quenching end temperature" is a temperature of a surface of a steel plate at the end of the quenching. For example, when the quenching is performed by water cooling, the temperature at the start of the water cooling is a "quenching start temperature" and the temperature at the end of the water cooling is a "quenching end temperature".

(Direct Quenching)

When the quenching is direct quenching, after the hot rolling, the hot-rolled steel plate is quenched without reheating. At that time, the quenching start temperature is the $Ar_3$ transformation point or higher. This is because the quenching is started from an austenite state to obtain a martensite structure. When the quenching start temperature is less than the $Ar_3$ transformation point, hardening is insufficient so that the steel plate cannot have adequately improved hardness, thus reducing the abrasion resistance of a finally obtained steel plate. On the other hand, the quenching start temperature may have any upper limit in the direct quenching, but the quenching start temperature is preferably 950° C. or less. The quenching end temperature will be discussed later.

The $Ar_3$ transformation point is determined by the following Formula (3):

$$Ar_3(^\circ\,C.) = 910 - 273 \times C - 74 \times Mn - 57 \times Ni - 16 \times Cr - 9 \times Mo - 5 \times Cu \quad (3)$$

where each element symbol in Formula (3) indicates a content, in mass %, of a corresponding element and is taken to be 0 when the corresponding element is not contained.

(Reheating Quenching)

When the quenching is reheating quenching, after completion of the hot rolling, the hot-rolled steel plate is reheated and then quenched. At that time, the quenching start temperature is the $Ac_3$ transformation point or higher.

This is because the quenching is started from an austenite state to obtain a martensite structure. When the quenching start temperature is less than the $Ac_3$ transformation point, hardening is insufficient so that the steel plate cannot have adequately improved hardness, thus reducing the abrasion resistance of a finally obtained steel plate. On the other hand, the quenching start temperature has any upper limit in the reheating quenching, but the quenching start temperature is preferably 950° C. or less. The quenching end temperature will be discussed later.

The $Ac_3$ transformation point is determined by the following Formula (4):

$$Ac_3(°\ C.)=912.0-230.5\times C+31.6\times Si-20.4\times Mn-39.8\times Cu-18.1\times Ni-14.8\times Cr+16.8\times Mo \quad (4)$$

where each element symbol in Formula (4) indicates a content, in mass %, of a corresponding element and is taken to be 0 when the corresponding element is not contained.

(Average Cooling Rate)

The quenching has no particular cooling rate. The cooling rate may be any value which enables a martensite phase to be formed. For example, the average cooling rate from the quenching start to the quenching end is preferably 20° C./s or more, and more preferably 30° C./s or more. Further, the average cooling rate is preferably 70° C./s or less, and more preferably 60° C./s or less. The average cooling rate is determined using a temperature of a surface of a steel plate.

(Cooling End Temperature)

The quenching process may have any cooling end temperature which generates martensite, but when the cooling end temperature is the Mf temperature or lower, the rate of a martensite structure is increased to further improve the hardness of the steel plate. Therefore, the cooling end temperature is preferably the Mf temperature or lower. On the other hand, the cooling end temperature may have any lower limit, but the cooling end temperature is preferably 50° C. or more because an unnecessarily long cooling time decreases manufacturing efficiency. The Mf temperature can be determined from the following Formula (5):

$$Mf(°\ C.)=410.5-407.3\times C-7.3\times Si-37.8\times Mn-20.5\times Cu-19.5\times Ni-19.8\times Cr-4.5\times Mo \quad (5)$$

where each element symbol in Formula (5) indicates a content, in mass %, of a corresponding element and is taken to be 0 when the corresponding element is not contained.

(Tempering)

After completion of the quenching, the quenched hot-rolled steel plate is reheated to a tempering temperature. The quenched steel plate is tempered by the reheating. At that time, the tempering is performed under conditions such that a P value is $1.20\times10^4$ to $1.80\times10^4$ to thereby obtain prescribed hardness in the surface layer and the mid-thickness part, the P value being defined by the following Formula (2):

$$P=(T+273)\times(21.3-5.8\times C+\log(60\times t)) \quad (2)$$

where, C indicates the C content (in mass %) in the steel plate, T indicates the tempering temperature (° C.), and t indicates the holding time (min.) in the tempering.

When the P value is less than $1.20\times10^4$, the tempering is insufficient so that hardness of one or both of the surface layer and the mid-thickness position cannot be in a desired range. On the other hand, when the P value is beyond $1.80\times10^4$, the hardness in the surface layer is significantly decreased, and thus does not reach a prescribed value.

When the heating temperature T is too low, manufacturing efficiency is decreased. Therefore, the heating temperature T is desirably 200° C. or more. When the heating temperature T is too high, heat treatment costs are increased. Therefore, the heating temperature T is preferably 600° C. or less.

In terms of manufacturing efficiency and heat treatment costs, the holding time t is preferably 180 minutes or less, more preferably 100 minutes or less, and further preferably 60 minutes or less. On the other hand, considering the uniformity of a microstructure, the holding time t is preferably 5 minutes or more.

The tempering can be performed by any method such as heating with a heat treatment furnace, high frequency induction heating, and electrical resistance heating.

EXAMPLES

Next, a more detailed description is given below based on Examples. The following Examples merely represent preferred examples, and the disclosure is not limited to these Examples.

Firstly, steel slabs (steel raw material) having the chemical composition listed in Table 1 were manufactured by continuous casting.

Then, the obtained steel slabs were sequentially subjected to heating, hot rolling, quenching (direct quenching or reheating quenching), and tempering to obtain steel plates. Table 2 lists treatment conditions of each process. The "plate thickness" listed in the column of "Hot rolling" is a plate thickness of a finally obtained abrasion-resistant steel plate.

The quenching was direct quenching or reheating quenching. In direct quenching, the hot-rolled steel plate was directly subjected to quenching by water cooling. In reheating quenching, the hot-rolled steel plate was air-cooled, then heated to a prescribed reheating temperature, and subsequently quenched by water cooling. The water cooling in the quenching was performed by passing the hot-rolled steel plate while spraying a high flow rate of water to the front and back surfaces of the steel plate. The cooling rate in quenching was an average cooling rate from 650° C. to 300° C. which was determined by heat transfer calculation. The cooling was performed to 300° C. or less.

In each of the obtained steel plates, the Brinell hardness and the microstructure in the depth position of 1 mm from the surface of the steel plate and the mid-thickness position (½ t position) of the steel plate were evaluated by the following method. The evaluation results are listed in Table 2.

[Hardness (Brinell Hardness)]

As an index of abrasion resistance, hardness was measured in the surface layer and the mid-thickness part of each steel plate. Test pieces used for the measurement were taken from each steel plate obtained as described above so that the depth position of 1 mm from the surface of each steel plate and the mid-thickness position thereof might be test surfaces. The test surfaces of the test pieces were mirror-polished, and then measured for the Brinell hardness in accordance with JIS Z2243 (2008). The measurement used a tungsten hard ball with a diameter of 10 mm under a load of 3000 Kgf.

[Microstructure]

Test pieces for microstructure observation were taken from each obtained steel plate, and were polished and etched (nital etching solution). The microstructure was imaged at the position of 1 mm from the surface and the mid-thickness position using an optical microscope (400× magnification). The obtained images were subjected to image interpretation to identify each phase. At least five fields were imaged. For the microstructure of the surface layer, a phase which accounts for 95% or more of the area fraction is listed as a main phase in Table 2.

TABLE 1

| Steel sample ID | Chemical composition (mass %) * C | Si | Mn | P | S | Al | Cr | N | O | Cu | Ni | Mo | V |
|---|---|---|---|---|---|---|---|---|---|---|---|---|---|
| A | 0.28 | 0.25 | 1.55 | 0.011 | 0.0033 | 0.026 | 0.98 | 0.0027 | 0.0029 | — | — | — | — |
| B | 0.29 | 0.38 | 0.88 | 0.007 | 0.0024 | 0.021 | 1.03 | 0.0019 | 0.0019 | 0.55 | 1.55 | — | — |
| C | 0.27 | 0.55 | 1.92 | 0.007 | 0.0019 | 0.029 | 0.30 | 0.0030 | 0.0024 | — | — | 0.38 | — |
| D | 0.30 | 0.96 | 0.73 | 0.012 | 0.0033 | 0.015 | 0.78 | 0.0023 | 0.0019 | — | — | 0.48 | — |
| E | 0.33 | 0.19 | 0.33 | 0.015 | 0.0021 | 0.027 | 1.44 | 0.0021 | 0.0020 | — | 1.24 | 0.50 | — |
| F | 0.26 | 0.56 | 1.67 | 0.012 | 0.0012 | 0.026 | 1.34 | 0.0025 | 0.0022 | — | — | — | 0.03 |
| G | 0.28 | 0.63 | 1.38 | 0.005 | 0.0023 | 0.021 | 1.31 | 0.0020 | 0.0038 | — | 1.00 | — | — |
| H | 0.24 | 0.23 | 1.23 | 0.006 | 0.0007 | 0.028 | 1.97 | 0.0029 | 0.0022 | — | — | — | 0.03 |
| I | 0.27 | 0.72 | 0.45 | 0.005 | 0.0030 | 0.031 | 1.39 | 0.0029 | 0.0020 | 0.31 | 0.34 | 0.39 | — |
| J | 0.28 | 0.17 | 1.28 | 0.015 | 0.0013 | 0.034 | 0.72 | 0.0019 | 0.0034 | — | — | 0.48 | — |
| K | 0.36 | 0.42 | 1.46 | 0.012 | 0.0006 | 0.016 | 0.33 | 0.0023 | 0.0029 | — | 1.55 | — | — |
| L | 0.20 | 0.78 | 1.98 | 0.007 | 0.0040 | 0.024 | 1.55 | 0.0021 | 0.0028 | — | — | — | — |
| M | 0.28 | 0.38 | 1.27 | 0.012 | 0.0023 | 0.019 | 0.48 | 0.0021 | 0.0019 | — | 0.23 | 0.13 | — |
| N | 0.23 | 0.25 | 1.02 | 0.006 | 0.0007 | 0.028 | 0.98 | 0.0029 | 0.0022 | — | 0.98 | 0.21 | — |
| O | 0.34 | 0.24 | 0.98 | 0.007 | 0.0008 | 0.027 | 1.03 | 0.0027 | 0.0019 | — | 1.02 | 0.22 | — |

| Steel sample ID | Chemical composition (mass %) * W | Co | Nb | Ti | B | Ca | Mg | REM | DI* | Ar3 (° C.) | Ac3 (° C.) | Mf (° C.) | Classification |
|---|---|---|---|---|---|---|---|---|---|---|---|---|---|
| A | — | — | — | — | — | — | — | — | 128 | 703 | 809 | 217 | Conforming steel |
| B | — | — | — | — | — | — | — | — | 172 | 658 | 774 | 194 | Conforming steel |
| C | — | — | — | 0.015 | 0.0012 | — | — | — | 201 | 686 | 830 | 216 | Conforming steel |
| D | — | — | — | — | — | 0.0031 | — | — | 220 | 757 | 855 | 236 | Conforming steel |
| E | — | — | — | — | — | — | — | — | 217 | 697 | 800 | 207 | Conforming steel |
| F | 0.03 | — | — | — | — | — | — | — | 214 | 694 | 816 | 211 | Conforming steel |
| G | — | 1.00 | — | — | — | — | — | — | 238 | 653 | 802 | 194 | Conforming steel |
| H | 0.03 | — | 0.012 | 0.015 | 0.0011 | — | — | — | 179 | 722 | 810 | 226 | Conforming steel |
| I | — | — | — | — | — | — | 0.0028 | — | 226 | 756 | 831 | 236 | Conforming steel |
| J | — | — | 0.013 | 0.013 | 0.0012 | — | — | 0.0032 | 208 | 723 | 824 | 230 | Conforming steel |
| K | — | — | — | 0.014 | 0.0013 | — | — | — | 130 | 610 | 780 | 169 | Comparative steel |
| L | — | — | 0.011 | 0.012 | 0.0011 | — | — | — | 244 | 684 | 827 | 218 | Comparative steel |
| M | — | — | — | 0.011 | 0.0012 | — | — | — | 115 | 718 | 824 | 231 | Comparative steel |
| N | — | — | — | — | — | — | — | — | 182 | 698 | 817 | 237 | Conforming steel |
| O | — | — | — | — | — | — | — | — | 227 | 668 | 791 | 192 | Conforming steel |

* The balance being Fe and inevitable impurities

TABLE 2

| | | Manufacturing conditions | | | | | | | | | | |
|---|---|---|---|---|---|---|---|---|---|---|---|---|
| | | Steel | Heating | Hot rolling | | Direct quenching | | | | Reheating quenching | | |
| No. | Steel sample ID | slab thickness (mm) | Heating temperature (° C.) | Rolling finish temperature (° C.) | Plate thickness (mm) | Cooling method | Quenching start temperature (° C.) | Quenching end temperature (° C.) | Cooling rate (° C./s) | Reheating temperature (° C.) | Holding time (min.) | Cooling method |
| 1 | A | 250 | 1120 | 880 | 50 | air cooling | — | — | — | 900 | 10 | water cooling |
| 2 | A | 250 | 1120 | 880 | 50 | air cooling | — | — | — | 880 | 5 | water cooling |
| 3 | A | 250 | 1120 | 880 | 50 | air cooling | — | — | — | 910 | 10 | water cooling |
| 4 | A | 250 | 1120 | 880 | 50 | air cooling | — | — | — | 880 | 10 | water cooling |
| 5 | A | 250 | 1120 | 890 | 50 | air cooling | — | — | — | 900 | 5 | water cooling |
| 6 | B | 250 | 1120 | 880 | 75 | water cooling | 850 | 150 | 35 | — | — | — |
| 7 | B | 250 | 1120 | 890 | 75 | water cooling | 850 | 190 | 40 | — | — | — |
| 8 | B | 250 | 1120 | 880 | 75 | water cooling | 850 | 50 | 30 | — | — | — |
| 9 | B | 250 | 1120 | 880 | 75 | water cooling | 850 | 170 | 35 | — | — | — |
| 10 | B | 250 | 1120 | 880 | 75 | water cooling | 860 | 100 | 30 | — | — | — |

TABLE 2-continued

| | Manufacturing conditions | | | | | Evaluation results | | | | | |
|---|---|---|---|---|---|---|---|---|---|---|---|
| | Reheating quenching | | Tempering | | | Depth 1 mm | | Mid-thickness | | Hard- | Classi- |
| No. | Quenching end temperature (° C.) | Cool-ing rate (° C./s) | Heating temper-ature (° C.) | Hold-ing time (min.) | P/ $10^4$ | $HB_1$ (HBW 10/3000) | Micro-structure* (main phase) | $HB_{1/2}$ (HBW 10/3000) | Micro-struc-ture* | ness ratio (%) | fication Classi-fication |
| 1 | 150 | 40 | 450 | 10 | 1.62 | 399 | TM | 336 | TB + TM | 84 | Example |
| 2 | 200 | 50 | 500 | 20 | 1.76 | 368 | TM | 304 | TB + TM | 83 | Example |
| 3 | 50 | 40 | 300 | 1 | 1.23 | 489 | TM | 414 | TB + TM | 85 | Example |
| 4 | 160 | 45 | 550 | 5 | 1.82 | 353 | TM | 289 | TB + TM | 82 | Comparative Example |
| 5 | 130 | 45 | 250 | 10 | 1.17 | 502 | TM | 414 | TB + TM | 82 | Comparative Example |
| 6 | — | — | 400 | 10 | 1.51 | 429 | TM | 354 | TB + TM | 83 | Example |
| 7 | — | — | 500 | 20 | 1.75 | 373 | TM | 296 | TB + TM | 79 | Example |
| 8 | — | — | 300 | 1 | 1.23 | 494 | TM | 394 | TB + TM | 80 | Example |
| 9 | — | — | 550 | 10 | 1.84 | 352 | TM | 274 | TB + TM | 78 | Comparative Example |
| 10 | — | — | 250 | 10 | 1.17 | 507 | TM | 394 | TB + TM | 78 | Comparative Example |

| | Manufacturing conditions | | | | | | | | | | | |
|---|---|---|---|---|---|---|---|---|---|---|---|---|
| | | Steel | Heating | Hot rolling | | Direct quenching | | | | Reheating quenching | | |
| No. | Steel sam-ple ID | slab thick-ness (mm) | Heating temper-ature (° C.) | Rolling finish temperature (° C.) | Plate thick-ness (mm) | Cooling method | Quenching start temperature (° C.) | Quenching end temperature (° C.) | Cool-ing rate (° C./s) | Reheating temperature (° C.) | Holding time (min.) | Cooling method |
| 11 | C | 300 | 1150 | 890 | 100 | air cooling | — | — | — | 880 | 10 | water cooling |
| 12 | D | 300 | 1120 | 890 | 100 | air cooling | — | — | — | 910 | 10 | water cooling |
| 13 | E | 300 | 1120 | 880 | 100 | air cooling | — | — | — | 850 | 10 | water cooling |
| 14 | F | 300 | 1120 | 890 | 100 | air cooling | — | — | — | 880 | 10 | water cooling |
| 15 | G | 300 | 1120 | 890 | 100 | air cooling | — | — | — | 910 | 10 | water cooling |
| 16 | H | 300 | 1180 | 880 | 100 | air cooling | — | — | — | 900 | 10 | water cooling |
| 17 | I | 300 | 1120 | 890 | 100 | air cooling | — | — | — | 910 | 10 | water cooling |
| 18 | J | 300 | 1180 | 890 | 100 | air cooling | — | — | — | 900 | 5 | water cooling |
| 19 | K | 250 | 1150 | 890 | 50 | air cooling | — | — | — | 900 | 5 | water cooling |
| 20 | L | 250 | 1180 | 890 | 50 | air cooling | — | — | — | 860 | 5 | water cooling |
| 21 | M | 250 | 1150 | 880 | 100 | air cooling | — | — | — | 900 | 5 | water cooling |
| 22 | N | 250 | 1120 | 880 | 50 | air cooling | — | — | — | 910 | 10 | water cooling |
| 23 | O | 250 | 1120 | 880 | 50 | air cooling | — | — | — | 910 | 10 | water cooling |

TABLE 2-continued

| | Manufacturing conditions | | | | | Evaluation results | | | | | |
|---|---|---|---|---|---|---|---|---|---|---|---|
| | Reheating quenching | | Tempering | | | Depth 1 mm | | Mid-thickness | | | |
| No. | Quenching end temperature (° C.) | Cooling rate (° C./s) | Heating temperature (° C.) | Holding time (min.) | P/$10^4$ | $HB_1$ (HBW 10/3000) | Microstructure* (main phase) | $HB_{1/2}$ (HBW 10/3000) | Microstructure* | Hardness ratio (%) | Classification Classification |
| 11 | 50 | 25 | 400 | 5 | 1.49 | 424 | TM | 336 | TB + TM | 79 | Example |
| 12 | 70 | 25 | 350 | 10 | 1.39 | 460 | TM | 374 | TB + TM | 81 | Example |
| 13 | 160 | 30 | 500 | 5 | 1.69 | 403 | TM | 308 | TB + TM | 77 | Example |
| 14 | 110 | 30 | 400 | 30 | 1.55 | 408 | TM | 325 | TB + TM | 80 | Example |
| 15 | 190 | 30 | 450 | 10 | 1.62 | 399 | TM | 322 | TB + TM | 81 | Example |
| 16 | 180 | 30 | 500 | 5 | 1.73 | 359 | TM | 265 | TB + TM | 74 | Example |
| 17 | 80 | 25 | 450 | 5 | 1.61 | 399 | TM | 319 | TB + TM | 80 | Example |
| 18 | 130 | 30 | 400 | 20 | 1.53 | 420 | TM | 332 | TB + TM | 79 | Example |
| 19 | 180 | 50 | 300 | 10 | 1.26 | 514 | TM | 440 | TB + TM | 86 | Comparative Example |
| 20 | 120 | 40 | 500 | 5 | 1.75 | 339 | TM | 335 | TB + TM | 99 | Comparative Example |
| 21 | 110 | 40 | 500 | 5 | 1.71 | 378 | TM | 253 | TB + TM | 67 | Comparative Example |
| 22 | 50 | 50 | 250 | 20 | 1.21 | 475 | TM | 436 | TB + TM | 92 | Example |
| 23 | 50 | 50 | 250 | 20 | 1.17 | 526 | TM | 495 | TB + TM | 94 | Comparative Example |

*M: martensite, TM: tempered martensite, B: bainite, TB: tempered bainite

As can be seen from Tables 1 and 2, Examples are abrasion resistant steel plates with a plate thickness of 50 mm or more which each have a Brinell hardness of 360 HBW10/3000 to 490 HBW10/3000 at the depth of 1 mm from a surface thereof, and have, in the mid-thickness part thereof, a Brinell hardness of 75% or more of the Brinell hardness at the depth of 1 mm from a surface. On the other hand, Comparative Examples which fail to satisfy the tempering conditions are different from Examples in the hardness of the surface layer or of the inside. Further, Comparative Examples which fail to satisfy the conditions of the C content have no hardness of the surface layer satisfying the conditions. Moreover, steel plate sample No. 22 has no DI* within the scope of the disclosure, and has a hardness ratio of 75% or less.

The invention claimed is:

1. An abrasion-resistant steel plate, having a chemical composition containing, in mass %, C: 0.23% to 0.34%,
Si: 0.05% to 1.00%,
Mn: 0.30% to 2.00%,
P: 0.020% or less,
S: 0.020% or less,
Al: 0.04% or less,
Cr: 0.05% to 2.00%,
N: 0.0050% or less, and
O: 0.0050% or less, with the balance being Fe and inevitable impurities, the chemical composition having a DI* value of 120 or more, where the DI* is defined by the following Formula (1):

$$DI^* = 33.85\times(0.1\times C)^{0.5}\times(0.7\times Si+1)\times(3.33\times Mn+1)\times(0.35\times Cu+1)\times(0.36\times Ni+1)\times(2.16\times Cr+1)\times(3\times Mo+1)\times(1.75\times V+1)\times(1.5\times W+1) \quad (1)$$

where each element symbol in the Formula (1) indicates a content, in mass %, of a corresponding element and is taken to be 0 when the corresponding element is not contained, wherein the abrasion-resistant steel plate has $HB_1$ of 360 HBW10/3000 to 490 HBW10/3000, the $HB_1$ being a Brinell hardness at a depth of 1 mm from a surface of the abrasion-resistant steel plate, wherein the abrasion-resistant steel plate has a hardness ratio of 75% or more, the hardness ratio being defined as a ratio of $HB_{1/2}$ to the $HB_1$, and the $HB_{1/2}$ being a Brinell hardness at a mid-thickness position of the abrasion-resistant steel plate, and wherein the abrasion-resistant steel plate has a plate thickness of 50 mm or more.

2. The abrasion-resistant steel plate according to claim 1, wherein the chemical composition further contains, in mass %, one or more selected from the group consisting of Cu: 0.01% to 2.00%,
Ni: 0.01% to 2.00%,
Mo: 0.01% to 1.00%,
V: 0.01% to 1.00%,
W: 0.01% to 1.00%, and
Co: 0.01% to 1.00%.

3. The abrasion-resistant steel plate according to claim 2, wherein the chemical composition further contains, in mass %, one or more selected from the group consisting of Nb: 0.005% to 0.050%,
Ti: 0.005% to 0.050%, and
B: 0.0001% to 0.0100%.

4. The abrasion-resistant steel plate according to claim 3, wherein the chemical composition further contains, in mass %, one or more selected from the group consisting of Ca: 0.0005% to 0.0050%, Mg: 0.0005% to 0.0050%, and REM: 0.0005% to 0.0080%.

5. The abrasion-resistant steel plate according to claim 2, wherein the chemical composition further contains, in mass %, one or more selected from the group consisting of Ca: 0.0005% to 0.0050%, Mg: 0.0005% to 0.0050%, and REM: 0.0005% to 0.0080%.

6. The abrasion-resistant steel plate according to claim 1, wherein the chemical composition further contains, in mass %, one or more selected from the group consisting of Nb: 0.005% to 0.050%, Ti: 0.005% to 0.050%, and B: 0.0001% to 0.0100%.

7. The abrasion-resistant steel plate according to claim 6, wherein the chemical composition further contains, in mass %, one or more selected from the group consisting of Ca: 0.0005% to 0.0050%, Mg: 0.0005% to 0.0050%, and REM: 0.0005% to 0.0080%.

8. The abrasion-resistant steel plate according to claim 1, wherein the chemical composition further contains, in mass %, one or more selected from the group consisting of Ca: 0.0005% to 0.0050%, Mg: 0.0005% to 0.0050%, and REM: 0.0005% to 0.0080%.

* * * * *